United States Patent [19]

Cusson

[11] Patent Number: 4,709,241

[45] Date of Patent: Nov. 24, 1987

[54] SATELLITE DISH ANTENNA FRAME

[75] Inventor: Paul R. Cusson, West Hartford, Conn.

[73] Assignee: N.S.M. Corporation, West Hartford, Conn.

[21] Appl. No.: 793,223

[22] Filed: Oct. 31, 1985

[51] Int. Cl.[4] ..... H01Q 15/14; H01Q 15/20

[52] U.S. Cl. ..... 343/916; 343/878; 343/915; 403/174

[58] Field of Search ..... 343/914, 915, 916, 878, 343/880, 912, 840; 403/174, 175, 178; 52/80, 82; 135/98, DIG. 9

[56] References Cited

U.S. PATENT DOCUMENTS

| | | | |
|---|---|---|---|
| 1,817,775 | 8/1931 | Sipe | 135/DIG. 9 |
| 3,335,535 | 8/1967 | Lane | 52/82 |
| 3,532,369 | 10/1970 | Reilly | 403/178 |
| 3,599,218 | 8/1971 | Williamson | 343/915 |
| 3,877,824 | 4/1975 | Jury | 403/174 |
| 4,223,932 | 9/1980 | Gonsalves | 403/174 |
| 4,249,184 | 2/1981 | Vines | 343/915 |
| 4,527,166 | 7/1985 | Luly | 343/915 |
| 4,552,438 | 11/1985 | Murphy | 343/915 |
| 4,568,945 | 2/1986 | Winegard et al. | 343/916 |
| 4,578,920 | 4/1986 | Bush et al. | 343/915 |

FOREIGN PATENT DOCUMENTS

| | | | |
|---|---|---|---|
| 1360242 | 3/1964 | France | 343/880 |
| 920530 | 3/1963 | United Kingdom | 343/915 |
| 1068382 | 5/1967 | United Kingdom | 403/175 |

*Primary Examiner*—Charles Frankfort
*Assistant Examiner*—Thomas B. Will
*Attorney, Agent, or Firm*—Chilton, Alix & Van Kirk

[57] ABSTRACT

A dish antenna frame having an extruded central hub, an outer rim and a plurality of intermediate extruded and bent arcuate tubular spokes, mounted on peripheral, radially extending fingers of the central hub and wherein each spoke mounting finger has extruded retention teeth and each tubular spoke has internal extruded teeth for rigidly retaining the spoke on the mounting finger.

2 Claims, 6 Drawing Figures

SATELLITE DISH ANTENNA FRAME

BACKGROUND AND SUMMARY OF THE INVENTION

The present invention relates generally to large dish-shaped antennae of the type having notable utility for receiving signals from satellite transmitters and having a reflecting surface support frame with a central hub, an outer rim and a plurality of angularly spaced radial spokes extending between the central hub and outer rim. The present invention relates more particularly to a dish antenna frame having a new and improved hub and a new and improved assembly of the hub and spokes.

A primary aim of the present invention is to provide in a dish antenna frame of the type described, a new and improved hub which can be economically manufactured as a transverse section of an extrusion of aluminum alloy or other suitable material.

Another aim of the present invention is to provide a new and improved dish antenna hub for securely mounting and rigidly retaining the spokes of the dish antenna frame and facilitating assembly of the hub and spokes in the field.

Another aim of the present invention is to provide in a dish antenna frame of the type described, a new and improved hub and spoke assembly wherein both parts are manufactured from extruded aluminum parts with minimum secondary operations and which provides for precisely positioning the spokes for accurately establishing the desired parabolic reflecting surface of the antenna dish.

A further aim of the present invention is to provide a new and improved hub and spoke assembly for a large dish antenna frame which enables the antenna dish to be readily assembled manually in the field by one man.

A further aim of the present invention is to provide a new and improved low cost extruded aluminum hub for a dish antenna frame which can be easily secured to its support. In accordance with the present invention, the hub is designed so that it can be secured first to its support and the antenna dish spokes, outer rim and reflecting material can then be readily mounted on the hub, all by one man in a relatively short period of time.

Other objects will be in part obvious and in part pointed out in more detail hereinafter.

A better understanding of the invention will be obtained from the following detailed description and the accompanying drawings of an illustrative application of the invention.

DESCRIPTION OF THE PREFERRED EMBODIMENT

Figure 1:
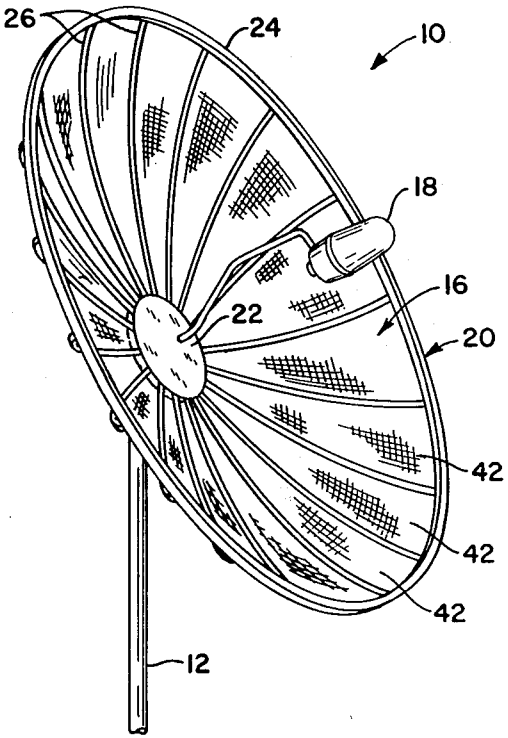
FIG. 1 is an elevation perspective view of a satellite dish antenna incorporating an embodiment of the present invention.

Referring to the drawings in detail wherein like numerals are used to designate like parts, a satellite dish antenna 10 incorporating an embodiment of the present invention is generally illustrated in FIG. 1. The dish antenna 10 comprises in a conventional manner, an upright support post 12, an antenna dish positioning mechanism (not shown) mounted on the post 12, a parabolic antenna dish 16 mounted on the dish positioning mechanism and a pick-up or transducer 18 suitably mounted at the focal point of the parabolic dish 16.

Figure 4:
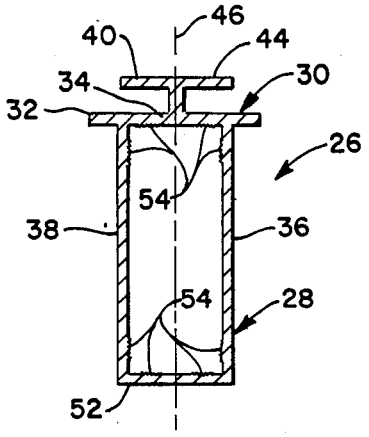
FIG. 4 is a transverse section view of a spoke of the dish antenna frame.

The antenna dish 16 has a frame 20 which comprises a central hub 22 mounted on the antenna positioning mechanism, an outer circular rim 24 and a plurality of equiangularly spaced spokes 26 extending radially between the central hub 22 and outer rim 24. The frame 20 is shown having eighteen spokes 26 but may have more or as few as ten spokes. Referring to FIG. 4, each spoke 26 is formed from an extruded aluminum beam comprising a box beam 28 and an I-beam 30. An inner flange 32 of the I-beam also serves as an inner end wall 34 of the box beam 28 and in addition has end portions extending laterally outwardly normal to the parallel side walls 36, 38 of the box beam. An outer flange 40 of the I-beam extends laterally to the planes of the outer surfaces of the box surfaces of the box beam side walls 36, 38. The oppositely opening elongated slots provided between the I-beam flanges 32, 40 are employed for receiving the edges of identical pie-shaped sections 42 of mesh material which form, together with the inner faces 44 of the eighteen spokes 26, the parabolic reflection surface of the antenna dish.

Each spoke 26 has a center plane of symmetry 46, which, in the assembled dish 16, extends through the central axis of the antenna dish. The spoke box beam 28, has an elongated transverse section opening with a longitudinal axis lying in the center plane of symmetry 46. As hereinafter more fully described, that opening is dimensioned to receive a mounting finger 50 of the central hub 22 for mounting the spoke 26 on the hub 22.

Figure 5:
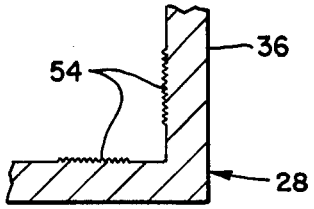
FIG. 5 is an enlarged view, partly broken away, of a portion of the transverse section view of FIG. 4.

The inner surfaces of the opposed parallel side walls 36, 38 and opposed parallel end walls 34, 52 of the spoke box beam 28 are extruded with opposed sections 54 of raised teeth adjacent to but spaced from the corners of the box beam 28. Each tooth section 54 may have approximately ten teeth as shown in FIG. 5 with each tooth having a height above the inner wall surface of approximately 0.01 inch. As more fully described hereinafter, the raised teeth assist in firmly mounting the spoke 26 on a hub finger 50 and in ensuring that the spoke is properly and accurately positioned on the hub finger 50.

The spokes 26, being important structural elements of the antenna dish frame 20, are made of a suitable high strength aluminum alloy and heat treated.

The extruded spoke beam is cut into predetermined lengths in accordance with the diameter of the antenna dish 16 (e.g. to provide an antenna dish 16 having a diameter of approximately ten feet), and then each cut length is formed by a suitable bending machine into an arcuate shape which provides the desired parabolic configuration. The arcuate spoke is then heat treated.

Figure 2:
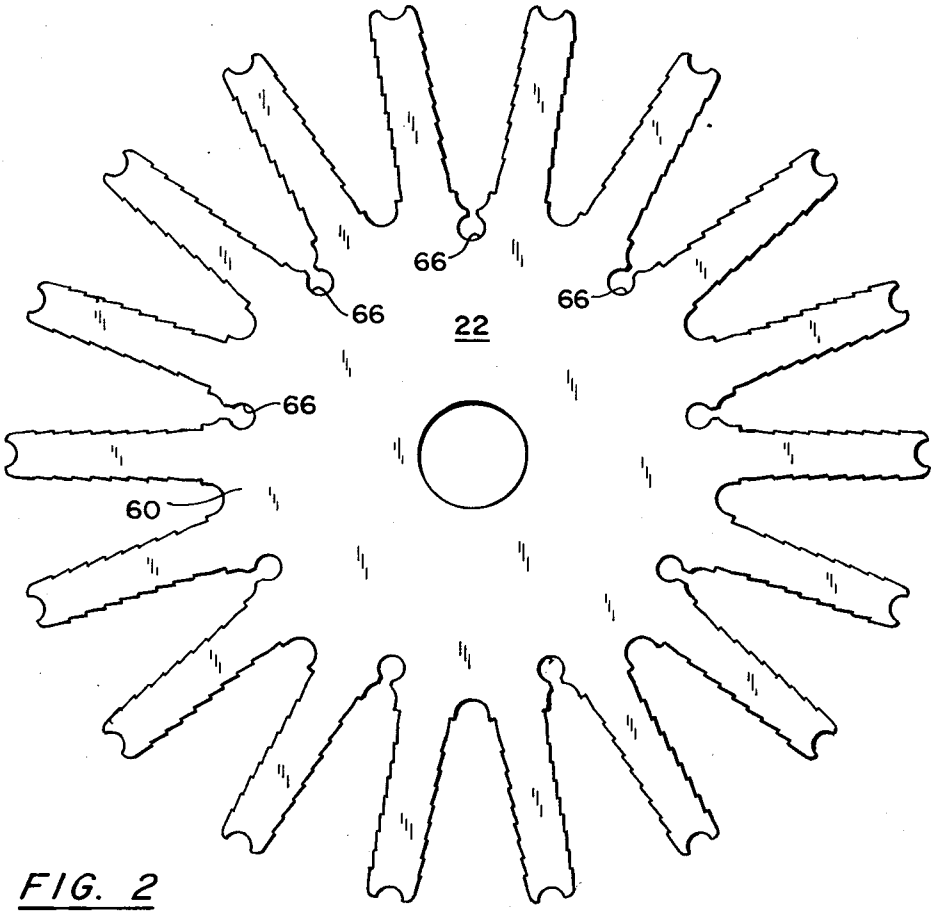
FIG. 2 is a front view of a hub of the dish antenna frame.
Figure 3:
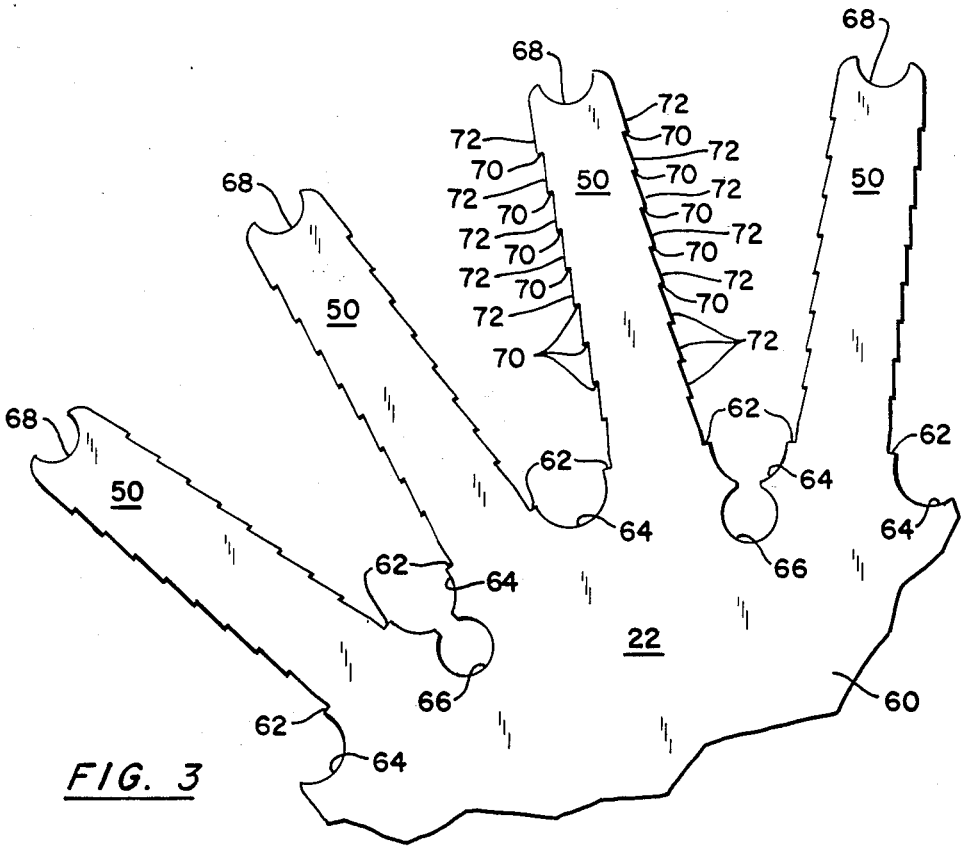
FIG. 3 is an enlarged partial front view, partly broken away, of the dish antenna hub.
Figure 6:
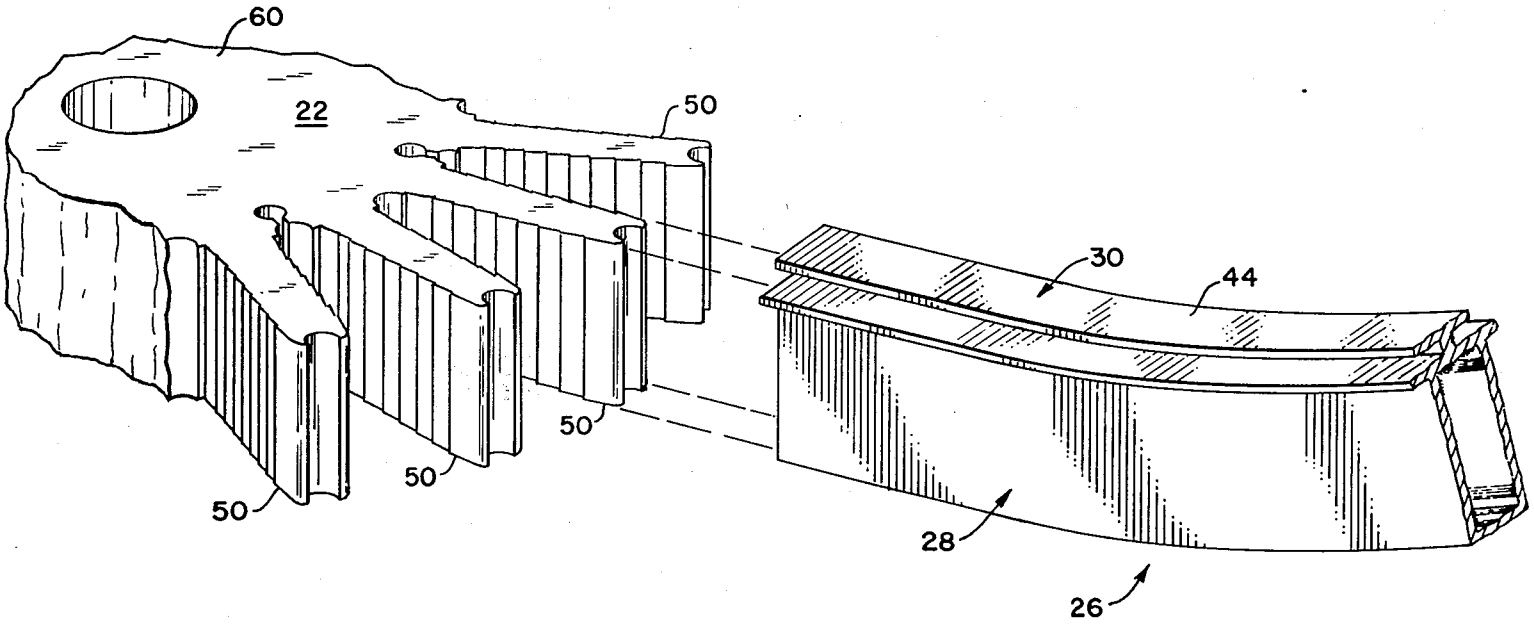
FIG. 6 is an exploded perspective view, partly broken away and partly in section, illustrating the manner of assembly of a spoke on the hub.

Referring to FIGS. 2 and 3, the central hub 22 of the dish antenna frame 20 is formed as a transverse planar section of an extruded bar of a suitable high strength aluminum alloy. The extruded hub section comprises a peripheral arrangement of equiangularly spaced, radially extending, identical spoke mounting fingers 50, to provide a spoke mounting finger 50 for each spoke 26, and a generally circular central hub section 60. A spoke 26 is mounted on each spoke mounting finger 50. Circumferentially extending extruded shoulders 62 at the base of each spoke mounting finger 50 provide abutments for engagement by the inner end of the respective spoke 26. The shoulders thereby establish the longitudinal position of the spoke 26 on the spoke mounting finger 50. Extruded, semicircular, radially outwardly opening, concave grooves 64 are provided in the central hub section 60 between each pair of adjacent circumferentially spaced abutment shoulders 62. In addition, an extruded fastener mounting groove 66 is provided inwardly of every other semicircular groove 64. The inner fastener mounting grooves 66 are extruded in the form of 270°-300° hole openings to provide fastener mounting openings for fastening the hub and, therefore, the entire antenna dish 16 to the dish positioning mechanism (not shown). The semicircular grooves 64 and fastener mounting grooves 66 also provide for reducing the weight of the hub 22 to reduce the cost of material and facilitate the extrusion of an elongated aluminum bar from which transverse sections are cut to form a plurality of the dish hubs 22. Also, the outer end of each spoke mounting finger 26 is preferably formed with a outwardly opening, generally semicircular, concave groove 68 to reduce the hub weight and cost and facilitate the extrusion process.

The hub 22 and therefore the hub extrusion have an outer diameter of for example approximately 8.5 to 12 inches. The central hub section 60 has with a diameter of for example approximately 4 to 6.5 inches. It has been found that such a large aluminum alloy part can be extruded as long as the weight of the extrusion is reduced by the provision of the described extruded grooves, etc. In addition, the extruded fastener mounting grooves 66 provide for fastening the hub 22 to its support without drilling holes into the hub or providing other means for that purpose. The hub 22 has a thickness of for example 1.8 inches and the hub extrusion is sawed into transverse sections having a slightly greater thickness and the sections are then suitably machined on both faces to provide a hub 22 having front and rear parallel flat faces. The transverse section is also heat treated to complete the hub manufacturing process. Thus, very little additional operation is required to produce the completed hub from the extruded bar.

The thickness of each spoke mounting finger 50 (and therefore the thickness of the entire hub 22) is established to be slightly less (e.g. 0.01 inch less) than the length of the transverse rectangular opening in the spoke box beam 28. The two pairs of oppositely facing teeth on the side walls 36, 38 of the box beam 28 engage the front and rear faces of the mounting finger 50 to grip the mounting finger 50 and ensure that the spoke 26 does not move fowardly or rearwardly relative to the mounting finger 50. Also, the box beam tooth sections 54 permit the slightly arcuate inner end of the spoke 26 to be inserted onto the straight mounting finger 50.

Each mounting finger 50 is formed with a plurality of V-shaped, extruded notches or grooves 70 on each side of the finger 50 to form a corresponding number of radially inwardly facing shoulders or teeth 72. Each finger 50 is shown having eight teeth 72 but may have more or fewer teeth 72. The maximum width of each finger (at the apex of opposed teeth 72) is substantially the same throughout the full length of the mounting finger 50 and is approximately the same as but slightly greater than the width of the transverse opening in the spoke box beam 28. The mimimum width of each mounting finger (at the bottom of opposed V-shaped grooves 70) is also substantially the same throughout the full length of the mounting finger 50 and is slightly less than the width of the spoke box beam opening. Each mounting finger 50 is thereby configured so that the spoke box beam 28 can be manually inserted onto the finger 50 and yet so that the spoke 26 is rigidly retained on the mounting finger 50 against both radial and circumferential movement or play. Although the retaining teeth 72 may be provided only on one side of the finger 50, preferably they are provided on both sides as shown in FIGS. 3 and 4. In addition, the two pairs of opposed tooth sections 54 on the side walls of the spoke box beam 28 engage and cooperate with the side teeth 72 on the mounting finger 50 to securely retain the spoke 26 on the mounting finger 50.

Accordingly, it can be seen that the teeth 54, 72 on the box beam 28 and mounting fingers 50 cooperate or interlock in several ways to securely retain the spoke 26 on the hub mounting finger 50. In addition, the extruded teeth 54, 72 actually facilitate mounting the spoke 26 on the hub 22 as well as provide the described force fit.

After spokes 26 are mounted on all of the hub mounting fingers 50, the pie-shaped sectors 42 of reflective mesh are inserted within the oppositely facing slots of adjacent spokes 26 and the outer rim 24 is mounted on the outer ends of the spokes 26. The outer rim is formed, for example, by six rim segments which are suitably secured together at their ends and suitably secured to the outer ends of each of the radiating spokes.

It will be seen from the foregoing that a dish antenna incorporating the present invention may be manually assembled by one man in the field in a relatively short time and yet, to produce a rigid and secure dish antenna which will provide reliable operation over a long service free life.

As will be apparent to persons skilled in the art, various modifications and adaptations of the above described embodiment of the present invention will become readily apparent without departure from the present invention, the scope of which is defined in the following claims.

I claim:

1. A central hub for use in a dish antenna frame having an outer rim and a plurality of angularly spaced, tubular spokes extending radially between the hub and outer rim, said hub comprising: a one-piece extrusion transverse section having a central portion and a plurality of angularly spaced, spoke mounting fingers, each finger receiving a respective one of the plurality of tubular spokes, extending integrally radially outwardly from said central portion, each spoke mounting finger being generally rectangular in transverse section and having circumferentially oppositely facing sides with extruded spoke retention teeth on at least one of the sides for rigidly retaining the respective tubular spoke in overlapping relation on the spoke mounting finger, wherein said central portion of the hub comprises a plurality of extruded, angularly spaced, radially outwardly opening, partially circular, fastener mounting grooves intermediate the spoke mounting fingers and forming openings for hub mounting fasteners.

2. A central hub for use in a dish antenna frame having an outer rim and a plurality of angularly spaced, tubular spokes extending radially between the hub and outer rim, said hub comprising: a one-piece extrusion transverse section having a central portion and a plurality of angularly spaced, spoke mounting fingers, each finger receiving a respective one of the plurality of tubular spokes, extending integrally radially outwardly from said central portion, each spoke mounting finger being generally rectangular in transverse section and having circumferentially oppositely facing sides with extruded spoke retention teeth on at least one of the sides for rigidly retaining the respective tubular spoke in overlapping relation on the spoke mounting finger, wherein the central portion of the hub comprises a first plurality of extruded, angularly spaced, radially outwardly opening, concave grooves intermediate and extending inwardly from the base of the mounting fingers and a second plurality of extruded, angularly spaced, partially circular, fastener mounting grooves inwardly of and radially outwardly opening into respective said first concave grooves and forming openings for hub mounting fasteners.

* * * * *